US005454609A

United States Patent [19]

Slocomb et al.

[11] Patent Number: 5,454,609

[45] Date of Patent: Oct. 3, 1995

[54] SNAP IN LATCH ASSEMBLY FOR WINDOWS

[75] Inventors: Colin L. Slocomb, Wilmington; Altan Husni, Middletown, both of Del.; Edward J. Subliskey, Mountain Top, Pa.

[73] Assignees: Slocomb Industries, Inc., Wilmington, Del.; Allen-Stevens Corp., West Hazleton, Pa.

[21] Appl. No.: 109,579

[22] Filed: Aug. 19, 1993

[51] Int. Cl.[6] ..... E05C 3/04

[52] U.S. Cl. ..... 292/337; 292/241; 292/DIG. 47

[58] Field of Search ..... 292/337, 240, 292/241, 203, DIG. 20, DIG. 33, DIG. 35, DIG. 46, DIG. 47, DIG. 53; 248/222.1, 222.4, 223.1, 224.1

[56] References Cited

U.S. PATENT DOCUMENTS

| | | | |
|---|---|---|---|
| 751,466 | 2/1904 | Colling | 211/162 |
| 1,900,936 | 3/1933 | Huttger | 292/DIG. 33 |
| 3,135,542 | 6/1964 | Wilkinson | 292/DIG. 20 |
| 3,731,956 | 5/1973 | Hanley | 248/223.1 |
| 4,801,164 | 1/1989 | Mosch | 292/DIG. 47 |
| 5,143,331 | 8/1992 | Robert | 248/222.4 |

*Primary Examiner*—Peter M. Cuomo
*Assistant Examiner*—Monica E. Millner
*Attorney, Agent, or Firm*—Connolly & Hutz

[57] ABSTRACT

A snap in latch assembly for selectively locking a movable member to a fixed member and preferably for locking double hung windows includes a keeper which would be secured to the hollow rail forming the frame of the fixed sash. A latch housing would be secured to the hollow rail forming the frame of the movable sash. Both the keeper and latch housing are secured to their respective rails in a snap in manner without the use of fasteners such as rivets or screws. The keeper includes at least one retainer pin having an undercut for snapping into a slot in its rail and includes at least one anchor member for engagement with the rail when the keeper is slid to its mounted position. The latch housing includes at least one retainer arm having an undercut for snapping into a slot in its rail with at least one locator bar engaging the rail when the housing is slid to its mounting position.

22 Claims, 2 Drawing Sheets

SNAP IN LATCH ASSEMBLY FOR WINDOWS

BACKGROUND OF THE INVENTION

There are various uses for latch assemblies to selectively lock a movable member to a fixed member. Such members include, for example, doors, gates and windows. The present invention is particularly directed to such frames which are formed by hollow extruded rails, such as in double hung windows where the fixed sash and the movable sash are extruded from plastic material such as polyvinylchloride. Such locking arrangements generally include a keeper mounted to the fixed or non-movable sash frame and a latch housing mounted to the movable sash frame. The latch housing includes a movable latch which may be pivotally mounted for selective movement into and out of the keeper to control the locking and unlocking of the window. Conventionally, the keeper and the latch housing are secured to their respective rails by various fastening devices, such as screws or pop rivets.

It would be desirable if techniques could be utilized for mounting keepers and latch housings to their rails in a effective manner which does not require such fasteners.

SUMMARY OF THE INVENTION

An object of this invention is to provide a latch assembly which includes a keeper which can be snapped into a hollow rail and secured to the rail without the use of rivets, screws or other fasteners.

A further object of this invention is to provide a latch assembly having a latch housing which also could be snapped into a hollow rail without the use of rivets, screws or other fasteners.

A still further object of this invention is to provide a latch assembly including such a latch housing and keeper which provide an effective locking action once mounted into place.

In accordance with this invention the snap in latch assembly includes a housing having an opening in its front wall. A latch member is movably mounted in the hollow interior of the housing. The latch member includes a latch end for selectively being moved into and out of the locking opening to selective locking and unlocking positions. The housing has a contact edge which abuts against the rail and is locked to the rail by means of at least one retainer arm having an undercut. The retainer arm snaps into a slot in the rail at a widened portion of the slot. The housing is then slid to a narrower portion of the slot. The contact edge also has at least a locator bar for engagement with the rail when the housing is slid to its mounted position.

In the preferred practice of the invention a pair of spaced retainer arms are mounted on the contact edge. Each arm is shaped to fit into a generally L-shaped slot of the rail. One leg of the L includes a widened portion to permit the arm to be inserted at that location and then slid toward the opposite end. When moved to the opposite end the undercut is located in the slot with the remainder of the arm below the slot. In the meantime, the corresponding locator bar snaps into the short leg of the L slot to prevent dislodgement of the housing.

The keeper is preferably in the form of a body member having a hollow interior with a locking opening to permit the latch end to be inserted into the keeper. The contact edge of the keeper which abuts against its rail, has at least one retainer pin with an undercut shaped to fit into the wide portion of a key hole slot in the rail. When the keeper is moved so that the retainer pin moves toward the narrow portion of the key hole slot, an anchor member on the contact edge snaps into a hole or recess in the rail to prevent dislodgement of the keeper.

THE DRAWINGS

DETAILED DESCRIPTION

The present invention is directed to a latch assembly for securing two members together. In the illustrated embodiment the members comprise a double hung window wherein the fixed sash or frame is formed by extruded rails and wherein the window is mounted to a movable sash or frame also formed by extruded rails. The sashes may take any known construction. The invention is not intended to be limited to any one particular form of construction. What is essential is that the rails are hollow so that the latch assembly components could be mounted by being snapped into the respective rails without the use of rivets, screws or other fasteners.

Figure 1:
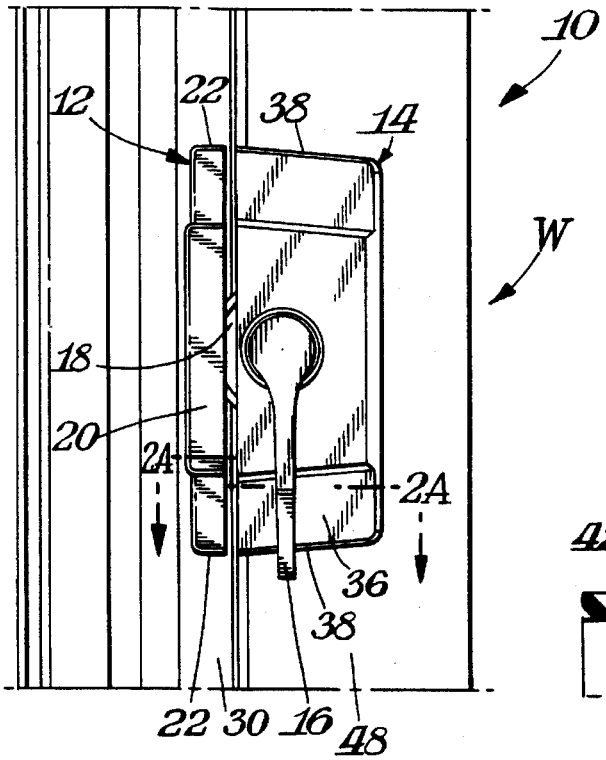
FIG. 1 is a top plan view of a latch assembly in accordance with this invention.
Figure 2A:
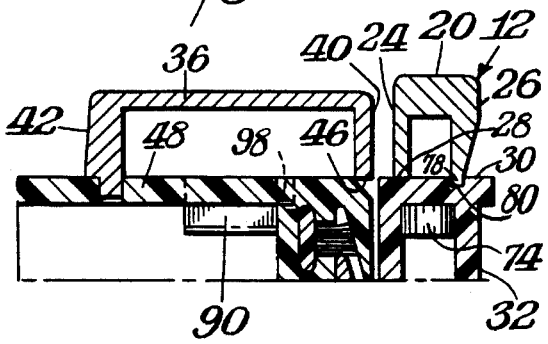
FIG. 2A is a cross-sectional view taken through FIG. 1 along the line 2A—2A.
Figure 2:
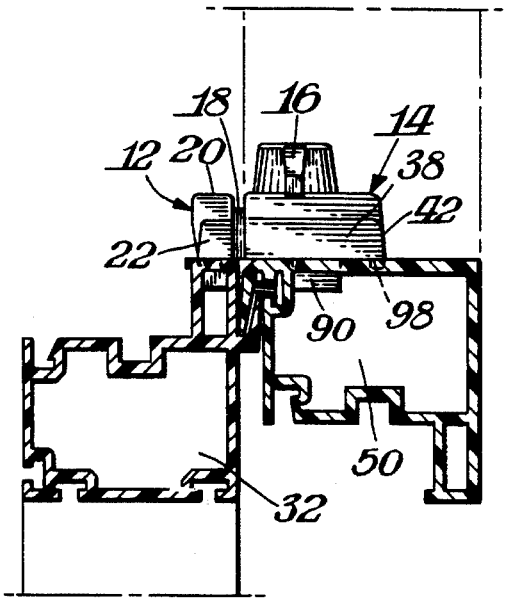
FIG. 2 is an end elevational view of the latch assembly shown in FIG. 1 with the hollow rails shown in section.
Figure 3:
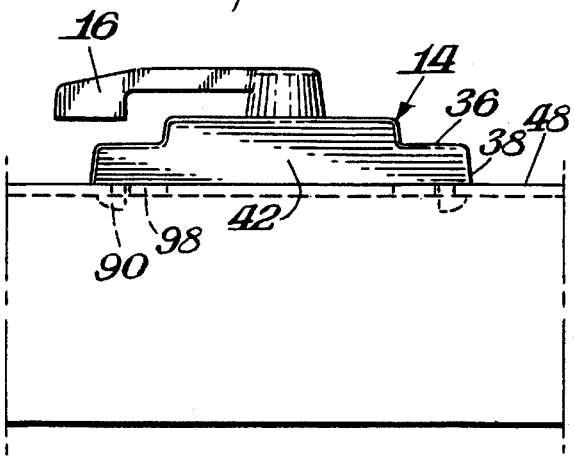
FIG. 3 is a rear elevational view of the latch assembly shown in FIGS. 1–2.

FIGS. 1–3 illustrate the latch assembly 10 which includes a keeper 12 and a housing 14. The housing 14 has a latch which includes a handle portion 16 and a latch end 18. Handle portion 16 is movably mounted such as being rotatably mounted to selectively move the latch end 18 into and out of keeper 12 in accordance with the selective locking and unlocking of the window W.

As shown in FIGS. 1–3 keeper 12 includes a top wall 20 and side walls consisting of two end walls 22,22 a front wall 24 and a rear wall 26. The interior of keeper 12 is hollow as best shown in FIG. 2A. The end walls and front and rear walls terminate in a contact edge 28 which abuts against the outer contact surface 30 of rail 32. It is to be understood that the use of such terms as top, front and rear is simply for relative orientation purposes and is not intended to mean that the components must be disposed in any particular orientation (such as in the illustrated orientation) since the locking assembly may be used in various orientations.

Figure 4:
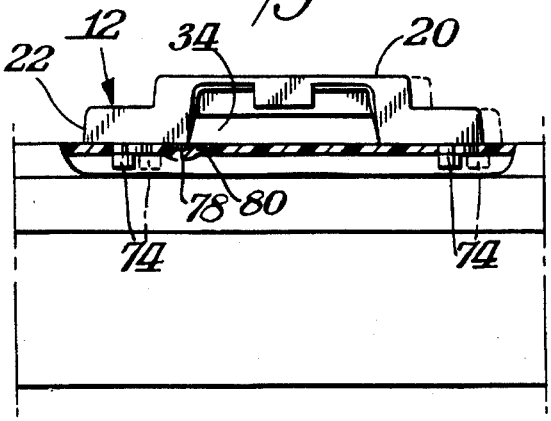
FIG. 4 is a front elevational view of the keeper shown in FIGS. 1–3 mounted to its rail with the rail partially broken away and in section.

As shown in FIG. 4 the front wall 24 includes a locking opening 34 which provides access to the hollow interior of keeper 12.

Housing 14 also includes a top wall 36 and side walls consisting of two end walls 38,38 as well as a front wall 40 and a rear wall 42 with a locking opening 44 (FIG. 9) being in the front wall 40.

Housing 14 has a contact edge 46 which is remote from top wall 36 and which is disposed against the contact surface 48 of its rail 50.

Figure 8:
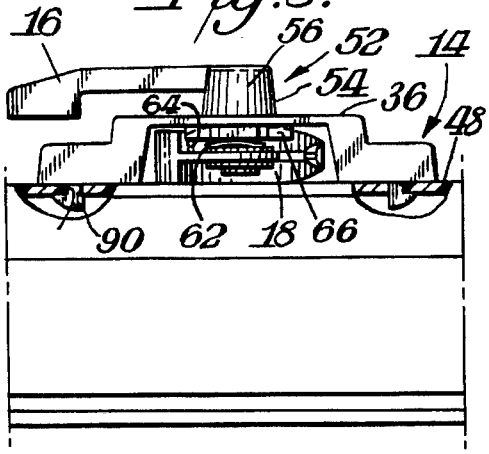
FIG. 8 is a front elevational view of the latch housing and its rail with the rail partly broken away and in section.
Figure 5:
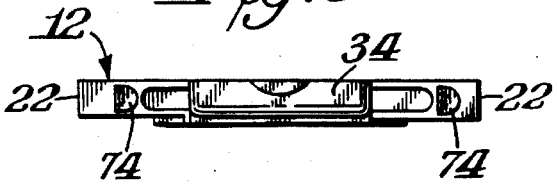
FIG. 5 is a bottom plan view of the keeper shown in FIG. 4.
Figure 9:
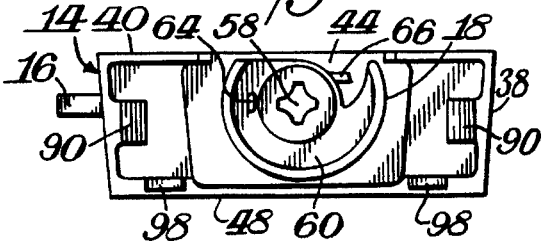
FIG. 9 is a bottom plan view of the latch housing shown in FIG. 8.

FIGS. 8–9 show the details of latch 52. As illustrated therein, latch 52 includes a hub 54 from which handle 16 extends. A pivot shaft 56 is mounted in hub 54 and is secured by a fastener 58 to a latch disc 60 which terminates in the latch arm or end 18. Thus, when handle 16 is rotated latch end 18 is selectively moved into and out of opening 44 in front wall 40 of housing 14. When the window sash rail 32 is disposed adjacent rail 50, as illustrated in FIGS. 1–3, opening 44 is aligned with opening 34 of keeper 12 so that latch end 18 enters keeper 12 to lock the movable rail or sash 32 to the fixed rail or sash 50. A tension spring 62 is provided around shaft 56 and reacts against disc 60 to maintain the latch 52 in its desired locking or unlocking position. A pair of stops 64,66 are provided for latch disc 60 to limit the rotational movement of the latch disc.

The specifically illustrated and described latch structure is included herein for exemplary purposes. It is to be understood that the invention is to be practiced with other latch structures. Thus, it is not necessary that the movement to and from the locking and unlocking positions be accomplished by a rotatable latch, instead other movable forms of latches could also be used such as linear sliding latch members.

Figure 6:
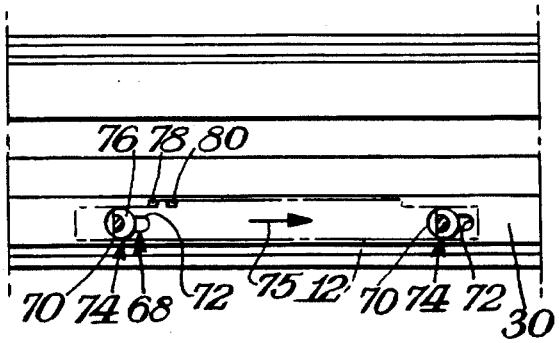
FIG. 6 is a top plan view of the window rail used with the keeper of FIGS. 4–5 and showing the keeper retainer pin in section.
Figure 7:
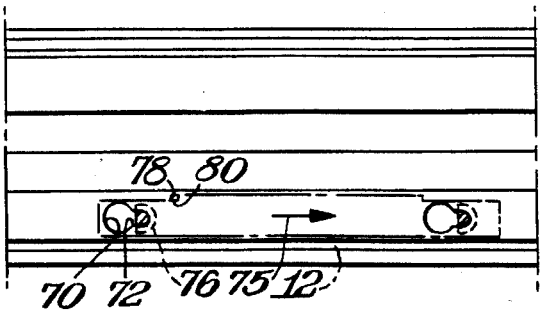
FIG. 7 is a view similar to FIG. 6 in a different phase of operation.

FIGS. 4–7 illustrate the details for the snap in securement of keeper 12 to rail 32. As shown in FIGS. 6–7 the top surface 30 of rail 32 includes a pair of key hole slots 68 having a wide end 70 and a narrow end 72. The contact edge 28 of keeper 12 includes at least one outwardly extending retainer pin 74. The number of retainer pins would correspond to the number of slots 68. FIGS. 4–7 illustrate two retainer pin and slot combinations. Each retainer pin 74 has an undercut 76 located outwardly from contact edge 28. The thickness of undercut 76 generally corresponds to the thickness of rail 32. Retainer pin 74 is dimensioned to fit into widened portion 70 of slot 68 but is larger in diameter than the diameter or width of narrow portion 72 of slot 68. Undercut 76, however, is of sufficiently small dimension to fit into narrow portion 72. Retainer pin 74 could thus be mounted to rail 32 by snapping the retainer pin 74 into slot 68 at the widened portion 70 as shown in FIG. 6. Keeper 12 would then be moved in the direction of arrow 75 toward the right as shown in FIG. 6 so that the undercut 76 slides in narrow portion 72 until the undercut 76 is at the end of narrow portion 72 as shown in FIG. 7. FIG. 4 illustrates the initial mounting in solid and the final mounting in phantom for keeper 12.

In order to prevent any dislodgement of keeper 12 when it is in its mounting position an anchor member 78 is provided on contact edge 28. Anchor member 78 may take any suitable form such as being a projection. It is not necessary that anchor member 78 be physically large and thus in the preferred practice of the invention anchor member 78 is simply a dimple. Top wall 30 of rail 32 includes a recess or detent 80 or other form of hole or opening in the path of movement of anchor member 78 and positioned so that anchor member 78 snaps into detent 80 when retainer pin 74 is moved to the extreme end of narrow portion 72 as shown in FIG. 7. Thus, when keeper 12 is moved to the mounting position, any tendency for the keeper to move back to its original position of FIG. 6 is prevented by the engagement of anchor member 78 with rail 32.

If desired a corresponding set of anchor member and detent may be provided for each pin 74 and slot 68. The invention, however, may be practiced with only a single anchor member and detent since a single set should be sufficient to prevent reverse sliding of keeper 12.

Similarly, any suitable number of retainer pins 74 and slots. 68 may be utilized. In the preferred practice of the invention two such pins/slots are used but a larger or smaller number may also be used within the practice of the invention.

Figure 10:
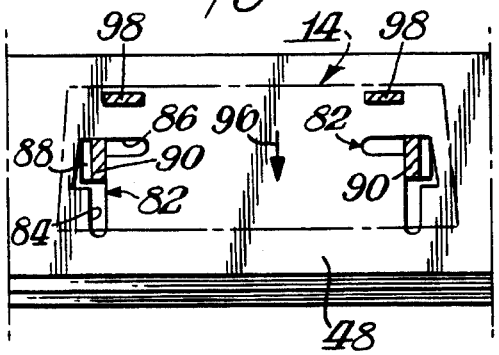
FIG. 10 is a plan view of the window rail used with the latch housing of FIGS. 8–9 and showing in section the retainer arms and locator bars.
Figure 11:
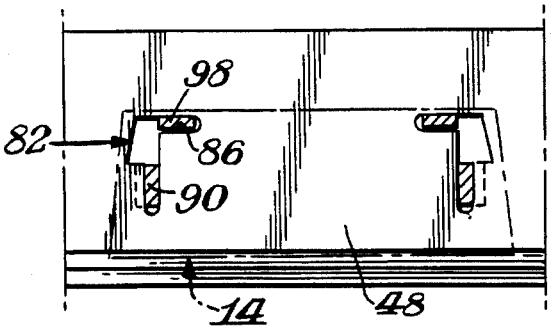
FIG. 11 is a view similar to FIG. 10 in a different phase of operation.

FIGS. 8–11 illustrate the manner of securing latch housing 14 to rail 50 in a snap in fashion. As shown in Figures 10–11 the top wall 48 of rail 50 includes a pair of mirror image generally L-shaped slots 82. Each slot 82 includes a long leg 84 and a short leg 86. An enlarged area 88 is provided at the end of long leg 84 where it is joined to short leg 86.

The contact edge 46 of housing 14 includes a retainer arm 90 for each of the slots 82. Retainer arm 90 has an undercut portion 94 extending from contact edge 46. The thickness of undercut 94 generally corresponds to the thickness of top wall 48 of rail 50. Retainer arm 90 is dimensioned so that it can fit into widened portion 88 of slot 82 but is larger than the width of the remainder of long leg 84. In operation, as shown in FIG. 10, retainer arm 90 would be inserted into slot 82 at widened portion 88. Housing 14 is then moved in the direction of the arrow 96 of FIG. 10 toward the end of long leg 84 to the position shown in FIG. 11. The slidable movement is possible by having the undercut 94 slide in leg 84.

In order to prevent any dislodgement of housing 14 by having a reverse movement from the position shown in FIG. 11 to the initial position shown in FIG. 10, anchoring or locating means are provided. Specifically, in the illustrated form each retainer arm 90 has an associated locator bar 98 mounted on contact edge 46. Locator bar 98 is positioned so that short leg 86 of slot 82 is in the path of movement of locator bar 98. Thus when retainer arm 90 is moved to its mounting position in FIG. 11, locator bar 98 is inserted into the short leg 86 of slot 82.

In the illustrated embodiment each retainer arm has a corresponding locator bar for the two sets of retainers/slots. It is to be understood, however, that the invention could be practiced by having only one locator bar. Similarly, it is to be understood that the anchoring of housing 14 could be achieved in the same manner of keeper 12 by the use of a dimple and detent. Additionally, the various types of slots shown in FIGS. 6 and 10 could be reversed for the keeper and housing, or the same types of slots and retainer structure could be used on both the keeper and housing.

The keeper 12 and housing 14 may be made of any suitable materials and preferably is made of a metal, such as a cast metal, having sufficient rigidity to maintain its shape and function in conjunction with the pvc extruded rails. In operation each keeper and housing can be effectively installed on its hollow extruded frame or rail by depressing the frame so that the retainer can enter the corresponding slot. The frame then snaps back to hold the keeper or housing mounted thereto by having the retainer engaged with the frame at the respective undercuts. Such an arrangement is both stronger and more economical than by using conventional screws and pop rivets.

The invention thus provides a quick and effective manner of mounting the components of a latch assembly without the need for separate fasteners such as screws or rivets.

It is to be understood that the invention may be practiced where, for example, a snap in keeper is used with a conventionally mounted housing or where a snap in housing is used with a conventionally mounted keeper. Thus, each of the housing and keeper in itself is unique and may be used without the other.

What is claimed is:

1. A snap in latch assembly for securement to a hollow rail comprising a housing, said housing having a top wall and side walls and a hollow interior, said side walls comprising a front wall and a rear wall and two intermediate end walls, said side walls terminating in a contact edge remote from said top wall, a locking opening in one of said side walls, a latch member movably mounted to said housing in said hollow interior, said latch member including a latch arm for being selectively moved into and out of said locking opening to a selective locking position and an unlocking position, at least one non-movably mounted retainer extending outwardly beyond said contact edge in a direction away from said top wall for snapping into a slot in the rail, said retainer having an undercut, and at least one non-movably mounted locator member extending outwardly beyond said contact edge in a direction away from said top wall for engagement with the rail when said housing is slid to its mounted position whereby said latch assembly may be mounted to a rail and locked in place without requiring manipulations of a separate fastener.

2. The assembly of claim 1 wherein there are at least two of said retainers.

3. The assembly of claim 2 wherein said retainer is in the form of a retainer arm.

4. The assembly of claim 3 wherein said locator member is a locator bar.

5. The assembly of claim 4 wherein one of said locator bars is provided for each of said retainer arms.

6. A snap in latch assembly for securement to a hollow rail comprising a housing, said housing having a top wall and side walls and a hollow interior, said side Walls comprising a front wall and a rear wall and two intermediate end walls, said side walls terminating in a contact edge remote from said top wall, a locking opening in one of said side walls, a latch member movably mounted to said housing in said hollow interior, said latch member including a latch arm for being selectively moved into and out of said locking opening to a selective locking position and an unlocking position, said contact edge having at least one retainer for snapping into a slot in the rail, retainer having an undercut, and said contact edge having at least one locator member for engagement with the rail when said housing is slid to its mounted position, said contact edge including at least two of said retainers, said retainer being in the form of a retainer arm, said locator member being a locator bar, in combination with said hollow rail, said hollow rail having a contact surface, said slot being in said contact surface, said slot being generally L-shaped with two generally perpendicular legs and a widened portion at the junction of said legs, said widened portion being wider than said retainer arm whereby said retainer arm can snap into said slot, said two legs comprising one leg and another leg, said one leg of said slot being in the path of motion of said retainer arm when said retainer arm is snapped into said slot, said one leg of said slot being wider than said undercut and narrower than said retainer arm, and said other leg of said slot being in the path of motion of said locator bar whereby said locator bar is disposed in said other leg of said slot when said housing is in its mounted position.

7. The assembly of claim 6 including a second rail, a keeper mounted to said second rail, and an opening in said keeper for selectively receiving said latch member to selectively lock said rails together.

8. The assembly of claim 7 wherein said keeper comprises a body member having a top wall and side walls and with a hollow interior, said side walls of said keeper terminating in a contact edge remote from said top wall of said keeper, said opening in said keeper being in one of said side walls of said keeper, said contact edge of said keeper having at least one retainer member extending therefrom, said second rail having a slot with a widened portion and a narrow portion, said widened portion being wider than said retainer member of said keeper, an undercut in said retainer member of said keeper, said keeper having a remainder portion other than said undercut, said narrow portion of said slot in said second rail being wider than said undercut of said keeper retainer member and narrower than said remainder portion of said keeper retainer member, and said contact edge of said keeper having at least one locator member for engagement with said second rail when said keeper is slid to its mounted position.

9. The assembly of claim 8 wherein said keeper includes at least two retainer members, each of said retainer members being in the form of said retainer pin, and said slot of said second rail being key hole shaped.

10. The assembly of claim 9 wherein said locator member of said keeper is a dimple, and said second rail including a detent for engagement by said dimple when said keeper is slid to its mounted position.

11. The assembly of claim 10 wherein said rails are part of a window frame having a fixed sash and a movable sash.

12. The assembly of claim 1 in combination with said rail, said slot having a widened portion and a narrow portion, said widened portion being wider than said retainer, said narrow portion being wider than said undercut and narrower than the remainder of said retainer.

13. A snap in keeper for securement to a hollow rail comprising a body member with a top wall and side walls and a hollow interior, said side walls comprising a front wall and a rear wall and two intermediate end walls, said side walls terminating in a contact edge remote from said top wall, a locking opening in said front wall whereby a latch may be selectively inserted through said locking opening into said hollow interior to create a locking position, at least one non-movably mounted retainer extending outwardly beyond said contact edge in a direction away from said top wall for snapping into a slot in the rail, said retainer having an undercut, and said at least one non-movably mounted locator member extending outwardly beyond said contact edge in a direction away from said top wall for engagement with the rail when said keeper is slid to its mounted position whereby said keeper may be mounted to a rail and locked in place without requiring manipulations of a separate fastener.

14. The keeper of claim 13 wherein said contact edge includes at least two of said retainers.

15. The keeper of claim 14 wherein said locator member is a dimple.

16. The keeper of claim 15 wherein said contact edge contains only a single locator member.

17. The keeper of claim 16 in combination with said hollow rail and said slot being key hole shaped.

18. The keeper of claim 13 in combination with said hollow rail and said slot being key holed shaped.

19. The keeper of claim 13 in combination with said hollow rail, said hollow rail being part of a window frame.

20. The keeper of claim 19 wherein said window frame is a fixed sash.

21. The keeper of claim 13 in combination with said rail, and said locator and said retainer being mounted in said slot.

22. The assembly of claim 1 in combination with said rail, and said locator and said retainer being mounted in said slot.

* * * * *